United States Patent [19]

Galet et al.

[11] Patent Number: 4,734,940

[45] Date of Patent: Apr. 5, 1988

[54] DEVICE FOR AFFIXING A RESPIRATORY MASK ONTO A PROTECTION HELMET

[75] Inventors: Adrien Galet, Chatillon sur Chalaronne, France; Hans-Joachim Walther, Lübeck, Fed. Rep. of Germany

[73] Assignee: Drägerwerk Aktiengesellschaft, Lübeck, Fed. Rep. of Germany

[21] Appl. No.: 18,313

[22] Filed: Feb. 24, 1987

[30] Foreign Application Priority Data

Feb. 25, 1986 [FR] France ..... 8603301

[51] Int. Cl.[4] ..... A42B 3/00; A42B 1/24

[52] U.S. Cl. ..... 2/422; 2/5; 2/6; 2/424; 292/147; 292/306

[58] Field of Search ..... 2/5, 6, 7, 422, 424, 2/425, 427, 428, 429, 430, 173; 292/147, 306

[56] References Cited

U.S. PATENT DOCUMENTS 2,051,969 8/1936 Shastock ..... 292/306 U X 4,555,815 12/1985 Walther ..... 2/424

FOREIGN PATENT DOCUMENTS 107644 6/1943 Sweden ..... 2/424

*Primary Examiner*—Wm. Carter Reynolds

*Attorney, Agent, or Firm*—Walter Ottesen

[57] ABSTRACT

A device ensuring the adaptation of a removable respiratory mask onto a protection helmet includes two attachment arms, each one of the arms having first and second elements slidingly engaging one another. The first element is pivotally connected to one side of the mask whereas the second element is provided with a hook coacting with a catch located on the headpiece of the helmet. An interior spring is compressed between a support surface of the first element and a flange of a movable rod. The second element has a latching lever for latching the rod in any desired position to adjust or readjust the compression of the spring, and accordingly, the application force of the mask onto the face.

13 Claims, 2 Drawing Sheets

DEVICE FOR AFFIXING A RESPIRATORY MASK ONTO A PROTECTION HELMET

FIELD OF THE INVENTION

The invention relates to a device for affixing a respiratory mask onto a protection helmet.

This device permits the adaptation as desired of a removable respiratory mask onto a protection helmet. The device belongs to a type comprising two lateral attachment arms. Each arm is made up of two elements slidingly mounted one with respect to the other and associated with an interior spring tending to make the one penetrate into the other. One element of each attachment arm is pivotally mounted at its front end to a side of the respiratory mask. The other element of this arm is provided at its rear end with a hook for cooperating with a catch located on a side of the headpiece of the helmet.

BACKGROUND OF THE INVENTION

A device of this type, which provides a non-permanent attachment between a respiratory mask and a helmet is described in French patent application no. 2,532,552 and European patent application no. 0,105,813. The device in question enables a person utilizing a helmet to place the respiratory mask on the face without having to remove the helmet. This device may have a very simple structure since it is sufficient to provide on the headpiece of the helmet two lateral engagement catches such as parts connected to the headpiece or formed as a unit with the headpiece. Such an assembly would be of interest principally to firemen, the military and the forces maintaining order, for certain activities.

The telescopic structure of the attachment arm and its interior spring permit the application of the respiratory mask onto the face of the person utilizing the helmet with sufficient tightness at the periphery of the mask and without effecting an preliminary adjustment of the length of the arms.

Nevertheless, when during the utilization of the helmet with the respiratory mask, the perspiration of the face produces a slippage of the mask so that it is desirable to compensate this effect by increasing the tension of the attachment arms. More generally, the need exists to make an initial adjustment and above all for subsequent readjustment of the application force of the respiratory mask on the face of the person wearing the mask.

SUMMARY OF THE INVENTION

It is an object of the invention to provide a simple means for modifying the tension of each attachment arm and, particularly, to permit readjusting the tension during the course of its use, without removing the mask.

To this effect, the device of the invention for affixing a respiratory mask onto a protection helmet includes an interior spring in each attachment arm. This spring is a helicoidal spring and is compressed between a support surface of one of the elements of the arm and an abutment provided on a movable member disposed so as to extend in the longitudinal direction of the arm. A means of retention is provided on the arm for latching the movable member in any position corresponding to a desired compression of the spring, or for releasing the movable member, thus permitting an adjustment or readjustment of the compression force of the spring.

It becomes thus possible for the user of the helmet to modify the applying force of the respiratory mask onto the face, particularly after the mask has been worn for a certain length of time, the applying force being adjusted according to temporary requirements of stability, tightness and comfort. The same means also permit initially pretensioning the spring to obtain an optimal application force of the mask onto the face of the wearer thereby adapting the helmet and the respiratory mask assembly to the particular morphology of each person wearing the same.

According to a preferred embodiment of the invention, the movable member already described is a movable rod, around which the helicoidal spring is disposed. The movable rod is provided with an abutment in the form of a flange where the front part of the spring is supported. The movable rod extends beyond the flange in a manner such that it protrudes outwardly from the attachment arm. The rear end of the helicoidal spring is supported on a fold provided at the rear end of the second element of each attachment arm. This fold contains an opening through which the movable rod extends.

The adjustment and readjustment of the compression of the spring are attainable by first unlatching the movable rod, and then pushing the rod at its front end through appropriately placed openings which allow the rod to slide over a sufficient distance.

In accordance with a particular embodiment of the invention, the means of retention has the form of a pivoted lever supported on the second element of each attachment arm. This lever has an outer or rear part for manipulating the same, and a front part which coacts with the movable rod to latch the rod in each desired position.

The pivoted lever has the form of an elbow and penetrates with a predetermined play a slot arranged in the front end of the second element of each attachment arm. The front part of the lever has an opening through which the movable rod extends. This latching lever provides an automatic latching of the movable rod in any desired position. This effect can be reinforced by providing a second spring in the interior of each attachment arm acting on the latching lever. This second spring returns the lever, thereby blocking or latching the movable rod.

According to another feature of the invention, the two elements of each attachment arm are made by cutting and bending metal plates. The two elements can be bent in a manner that each one has a U-shaped cross section with slanted legs. Once assembled, the attachment arm assembly has a trapezoidal cross section and the profiles of the two elements are fitted into one another to ensure a sliding engagement. A complete arm structure is thus obtained by simple and inexpensive means which is very resistant and provides good protection to the mechanism disposed in the inner space of the arm and which requires a minimum number of parts.

The hook of each attachment arm may simply be formed by a fold of the rear end of the second element of the attachment arm. Advantageously, the front end of the first element of the attachment arm also contains a fold on which a bracket is pivotally connected in an eccentric manner. The bracket is, in turn, connected to one side of the respiratory mask. Thus, a simple rotation of the bracket permits mounting the same attachment arm onto the right side or the left side of the respiratory mask. This contributes further to the simplicity, the economy and the convenience of using the device. Finally, the structure of the attachment arms permits a rapid assembly and disassembly thereof without tools, thus rendering the task extremely simple.

A more complete appreciation of the invention and many of the attendant advantages thereof will be readily perceived as the same becomes better understood by reference to the following detailed description when considered in connection with the accompanying figures.

Other objects, advantages and features of the invention will become apparent to those skilled in the art from the following description.

DESCRIPTION OF THE PREFERRED EMBODIMENTS OF THE INVENTION

Figure 1:
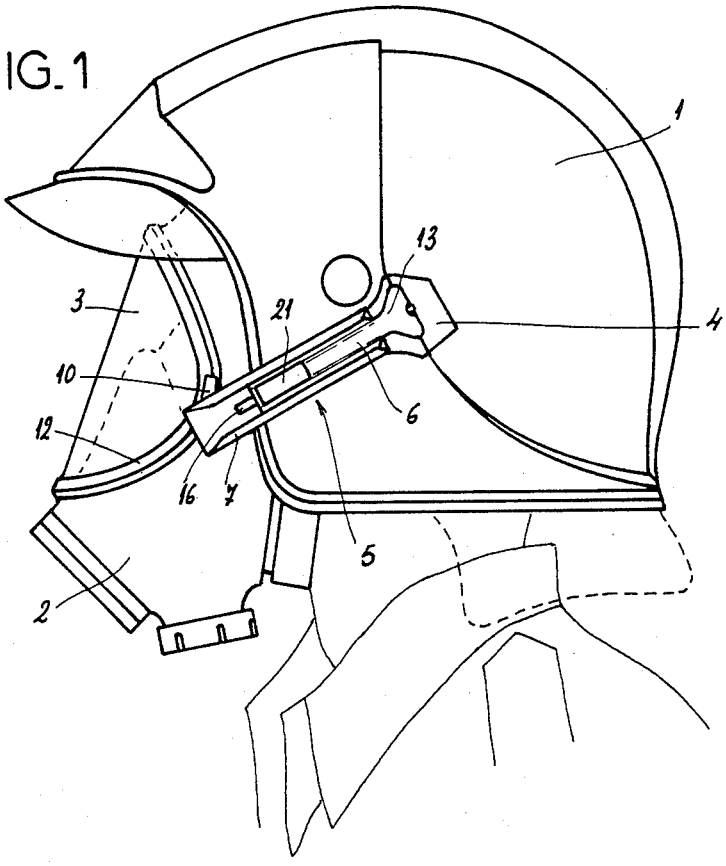
FIG. 1 is a side view showing the protection helmet and the associated respiratory mask in a position of simultaneous utilization.
Figure 5:
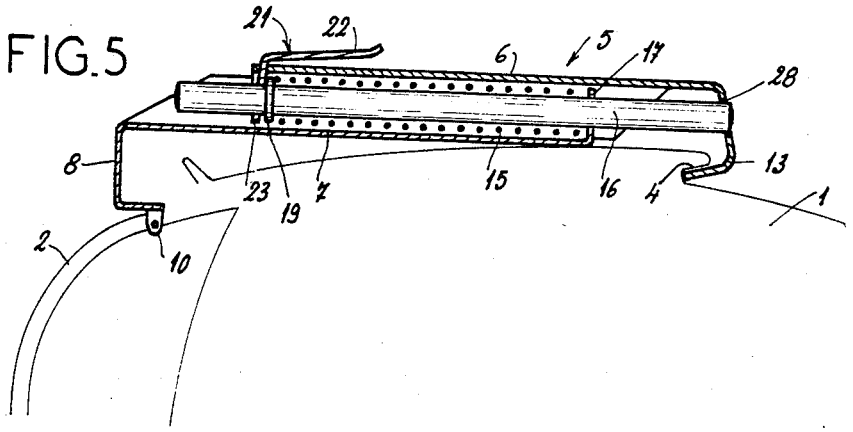
FIG. 5 is a longitudinal sectional view of the attachment arm, in a smaller scale and in position of utilization, the helmet and the mask being partially shown in outline; and, FIG. 6 is a similar view to that of FIG. 5, showing the same arm after readjustment of the tension.
Figure 6:
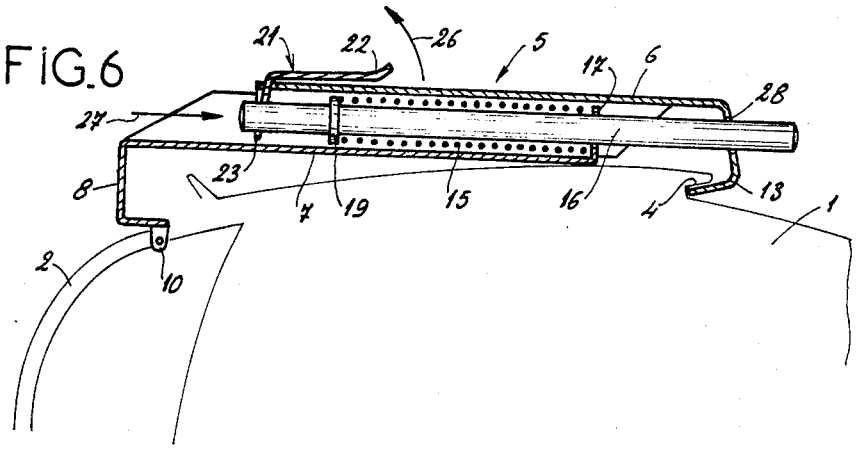

In FIG. 1 and also in FIGS. 5 and 6, a protection helmet is shown for example, for use by fire fighters. The helmet comprises a rigid exterior headpiece 1, in the interior of which is disposed a deformable lining (not shown), permitting the adaptation of the helmet onto the head of the wearer. The protection helmet is provided for the simultaneous use of a respiratory mask 2 covering the wearer's face completely and containing a visor 3. The headpiece 1 of the helmet is provided on both its outer sides with two engaging catches 4 for adapting the respiratory mask 2 to the helmet. One catch 4 can be seen in FIG. 1 and the other engaging catch (not shown) is symmetrical to the first. The respiratory mask 2 is provided with two lateral attachment arms 5. These are likewise symmetrically arranged to be engaged by the catches 4.

Figure 2:
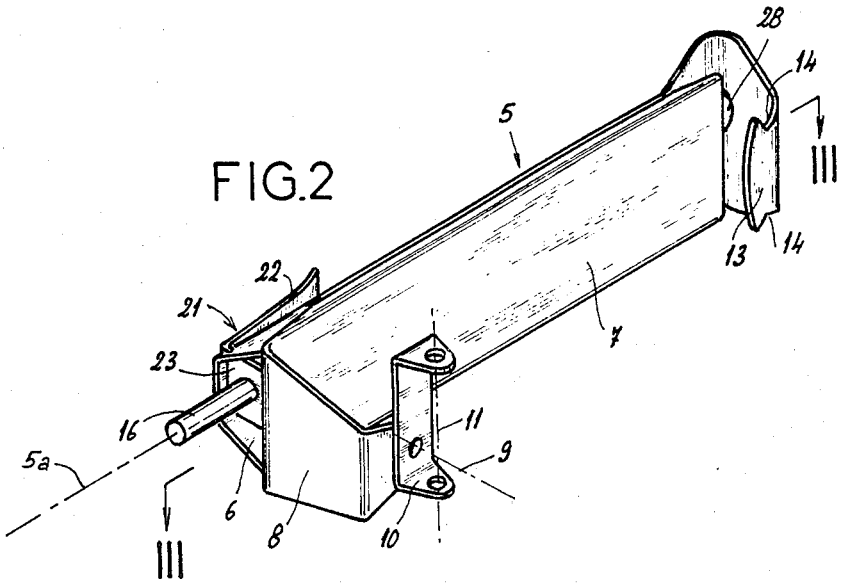
FIG. 2 is a perspective view of one of the attachment arms of the respiratory mask.
Figure 3:
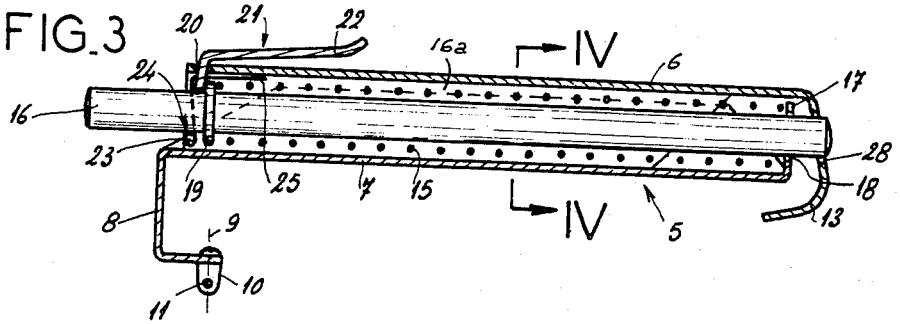
FIG. 3 is a longitudinal sectional view of the attachment arm, in a retracted state taken along line III—III of FIG. 2.
Figure 4:
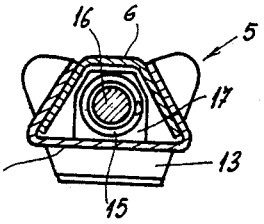
FIG. 4 is a cross-sectional view taken along line IV—IV of FIG. 3.

The structure of each one of the attachment arms 5 is more particularly shown in FIGS. 2 to 4. The arm 5 defines a longitudinal basis 5*a* and is formed principally by two elements 6 and 7 having a cross section in the form of a "U" with slanted legs as shown in FIG. 4. The second element 6 is slidingly mounted within the first element 7 and the two elements 6 and 7 conjointly define an elongated space 16*a* extending in the direction of the longitudinal axis 5*a*. The arm 5 thus has a telescopic configuration having a cross section of trapezoidal form. Each one of the two elements 6 and 7 of the arm 5 are formed of a single piece from a sheet metal plate suitably cut and bent.

The first element 7 of the attachment arm 5 includes at its front end a fold 8 on which a U-shaped bracket 10 is eccentrically mounted so as to be pivotable about a substantially horizontal axis 9. This bracket 10 is itself pivoted about an axis 11 perpendicular to the axis 9, on a side of the respiratory mask 2 in the vicinity of the frame 12 of the visor 3. The pivoted mounting of the bracket 10 on the fold 8 permits, upon rotation of the bracket 10, the attachment arm 5 to be attached to the right side or the left side of the respiratory mask notwithstanding the dissymmetry of the bracket 10 with respect to its own pivot axis 9.

The second element 6 of the arm 5 includes at its rear end a fold 13 which forms a hook for coacting with one of the engaging catches 4 of the headpiece 1 of the helmet. The hook 13 is itself provided with two mutually opposite indentations 14. These indentations 14 increase the safety of the engagement by preventing any disengagement from the catches 4 even in case of oblique force or in case of impact.

A resilient connection between the two elements 6 and 7 of each attachment arm 5 is provided by means of a helicoidal spring 15 under compression. The spring 15 is lodged inside arm 5 and is disposed in surrounding relationship to a movable rod 16 slideably mounted in the space 16*a* for movement in the direction of longitudinal axis 5*a*. The front end of the spring 15 seats on a flange 19 of the rod 16. This rod 16 extends beyond the flange 19 so as to project outwardly beyond the front end of the arm 5.

A slot 20 disposed near the front of the second element 6 of the attachment arm 5 is engaged with a predetermined play by a metal latching lever 21 having the form of an elbow. The latching lever 21 has a rear portion 22 defining an actuating lever, and a front portion 23 having a bore 24 formed therein through which the rod 16 extends. The front portion 23 is capable of latching the bar 16 in any desired position. A small spring 25 having the form of a folded leaf is lodged in the interior of the attachment arm 5. This small spring 25 acts on the latching lever 21 to resiliently urge the rear portion 22 in the direction toward the attachment arm 5.

In this most advanced position, the movement of the movable rod 16 is stopped by the abutting engagement of the flange 19 with the front portion 23 of the latching lever 21 as shown in FIGS. 3 and 5. The spring 15 has in this position its maximum permissible length with respect to the position of the two elements 6 and 7 relative to each other.

FIG. 3 shows the arm 5 in a retracted state since the arm is not hooked onto the headpiece of the helmet. During the use of the respiratory mask 2, as is shown by FIG. 5, the inner element 6 of the arm 5 extends out of the outer element 7 until the attachment arm 5 assumes a length sufficient to permit the engagement of the hook 13 onto the corresponding catch 4 of the headpiece 1 of the helmet. The spring 15 is then compressed further, and this spring 15 acts on the second element 6 in a direction to tend to cause the latter to reenter into the first element 7 thereby assuring the application of the respiratory mask 2 onto the face of the wearer.

If the wearer of the helmet and the respiratory mask desires to readjust the application force of the mask 2 onto the face, especially for retightening the mask, the wearer proceeds in the following manner illustrated by FIG. 6 for each attachment arm 5.

By pushing back on the front end of the rod 16 in the direction of arrow 27, the wearer of the helmet unlatches the latching lever 21 and rearwardly displaces the rod 16 with its flange 19 thereby compressing the spring 15 even more. The latching lever 21, being returned to its initial position by the spring 25, latches the rod 16 in its new position.

It should be noted that the rearward displacement of the rod 16 is permitted by a supplementary bore 28 provided in the fold which forms the hook 13.

The above-described device also permits the pretensioning of the spring 15 by placement of the respiratory mask 2. This device permits in addition a lowering of the compression of the spring 15 without removing the mask 2. The portion 23 of the latching lever 21 assures an automatic latching of the movable bar 16 in any desired position.

More particularly, for cancelling the supplementary compression of the spring 15 due to pushing the rod 16 in the direction of arrow 27, it suffices to move the rear portion 22 of the latching lever 21 in the direction of arrow 26. The automatic latching of the bar 16 in the front portion 23 of the latching lever 21 is thus released, and the spring 15 pushes back the flange 19 to bring it again in abutment with the portion 23 of the latching lever 21. This relaxes the supplementary compression of the spring 15.

By itself, the invention is not limited to fixing a respiratory mask onto a protection helmet as described above. The invention now being fully described, it will be apparent to one of ordinary skill in the art that many changes and modifications can be made thereto without departing from the spirit or scope of the invention as set forth herein. This particularly applies to the details of the forms, dimensions and materials of the elements constituting the device.

The present disclosure relates to the subject matter disclosed in French Application No. 86 03301 of Feb. 25, 1986, the entire specification of which is incorporated herein by reference.

What is claimed is:

1. A device for affixing a removable respiratory mask onto a protection helmet provided with a headpiece, said device comprising:

two engaging catches, each catch being mounted on one side of the headpiece of the helmet;

two lateral attachment arms, each arm being provided with first and second elements slidingly mounted on each other;

a spring tending to pull the two elements towards each other;

each one of said first elements having a front end at which it is pivotally mounted onto one side of the respiration mask, and a rear end;

each one of said second elements having a front end and a rear end, said rear end of said second element being provided with a hook for engaging the corresponding engaging catch;

said spring being a helicoidal spring;

each attachment arm further including a movable part which is slidingly movable along the longitudinal direction of the attachment arm, and an abutment provided on the movable part;

each second element further including means of retention having a first and a second position, wherein when the retaining means is in the first position the movable part is fixed at any desired spring compression, and when the retaining means is in the second position the movable part is freed for slidingly moving along the longitudinal direction of the attachment arm, thereby permitting the adjustment of the compression of the spring; and, each first element further including a supporting surface provided at its rear end, wherein the helicoidal spring is compressed between the supporting surface and the abutment.

2. The device of claim 1, wherein the movable part of the attachment arm is a movable rod around which the helicoidal spring is wound, said movable part having a front end pointing in the direction of the front ends of the first and the second elements; the abutment of the movable rod is a flange; and, the front end of the movable rod extends beyond the flange and protrudes from the attachment arm.

3. The device of claim 2, wherein the supporting surface of the first element of the attachment arm is a fold provided with an opening capable of receiving said rod therein.

4. The device of claim 3, wherein the rear end of the second element of the attachment arm is further provided with an end opening also capable of receiving said rod therein when the latter is pushed back.

5. The device of claim 1, wherein the means of retention of the second element of each attachment arm is a pivoted lever, the lever being further provided with a rear part for moving the lever towards and away from the attachment arm, and a front part for coacting with the movable part to fix the movable part at any desired spring compression; said front part pointing in the direction of the front ends of the first and second elements.

6. The device of claim 5, wherein: the front end of the second element of each attachment arm is further provided with a slot; said front part and said rear part conjointly being in the shape of an elbow with the front part penetrating the slot of the second element with a predetermined play and coacting with the movable part; and, the front part having an opening for receiving the movable part therein.

7. The device of claim 5, wherein: each attachment arm further comprises a second interior spring, one end of which presses against the front end of the pivoted lever tending to move the lever to its first position, thereby fixing the position of the movable part.

8. The device of claim 1, wherein: the first and the second elements of each attachment arm are made of sheet metal.

9. The device of claim 8, wherein: said first and second elements of each attachment arm are bent so as to have a U-shaped cross section with outwardly slanted legs and being disposed one inside the other so as to impart a trapezoidal shape to said arm.

10. The device of claim 8, wherein the second element of each attachment arm has a rearward part bent to define said hook thereof.

11. The device of claim 10, wherein said rearward part has two cutouts lying opposite each other which conjointly define said hook.

12. The device of claim 6, wherein the front end of the first element of each attachment arm comprises an end portion which is bent towards the rear end of the element; and, the device further comprising a bracket articulately and asymmetrically mounted to said end portion and to one side of the respiratory mask, whereby by rotating said bracket the attachment arm may be attached to either side of the respiratory mask.

13. A device for affixing a removable respiratory mask onto a protection helmet having a headpiece, the device comprising:

two engaging catches arranged on respective sides of the helmet;

two lateral arms for securing the mask to said catches; and, each of said lateral arms defining a longitudinal axis and including:

first and second elongated members telescopically and slidingly engaging each other so as to permit said members to move relative to each other in the direction of said axis, said elongated members conjointly defining an elongated space extending in the direction of said axis;

a movable member slidably mounted in said space for movement in the direction of said axis and having an abutment formed thereon;

said first elongated member having a forward end and a rearward end, said first elongated member having a bracket mounted thereon at said forward end for attaching said arm to the mask; and said first elongated member having a support surface formed thereon at said rearward end thereof;

said second elongated member having a rearward end facing in a direction opposite to said forward end of said first elongated member, said second elongated member having hook means formed thereon for engaging one of said catches;

resilient means interposed between said abutment means and said support surface for developing a first resilient force between said abutment means and said support surface;

latching means mounted on said second elongated member so as to be displaceable between a first latching means position whereat the resiliently biased movable member is unlatched and freely movable in the direction of said axis to a new location relative to said elongated members so as to change said first resilient force to a desired second resilient force and a second latching means position whereat said movable member is latched to said second elongated member to transmit said second resilient force to said second elongated member causing said second resilient force to act along said axis so as to tend to pull said first and second elongated members toward each other in closer telescopic engagement.

* * * * *

UNITED STATES PATENT AND TRADEMARK OFFICE

CERTIFICATE OF CORRECTION

PATENT NO. : 4,734,940

DATED : April 5, 1988

INVENTOR(S) : Adrien Galet and Hans-Joachim Walther

It is certified that error appears in the above-identified patent and that said Letters Patent is hereby corrected as shown below:

In column 1, line 41: delete "an" and substitute -- any -- therefor.

In column 3, line 53: delete "basis" and substitute -- axis -- therefor.

Signed and Sealed this

Ninth Day of August, 1988

*Attest:*

DONALD J. QUIGG

*Attesting Officer*

*Commissioner of Patents and Trademarks*